US006487975B1

(12) United States Patent
Gordon

(10) Patent No.: US 6,487,975 B1
(45) Date of Patent: Dec. 3, 2002

(54) ROLLER COASTER CAR HAVING A FORCE-ISOLATED PASSENGER COMPARTMENT

(76) Inventor: Jonathan I. Gordon, 65 Woods End Rd., Stamford, CT (US) 06905

( * ) Notice: Subject to any disclaimer, the term of this patent is extended or adjusted under 35 U.S.C. 154(b) by 0 days.

(21) Appl. No.: 09/643,076

(22) Filed: Aug. 21, 2000

(51) Int. Cl.[7] ..... A63G 31/02

(52) U.S. Cl. ..... 104/53; 104/57; 104/295; 472/59; 472/43

(58) Field of Search ..... 104/53, 57, 74, 104/83, 85, 295; 472/59, 43

(56) References Cited

U.S. PATENT DOCUMENTS

| | | | | | |
|---|---|---|---|---|---|
| 142,605 | A | | 9/1873 | Yates | |
| 803,465 | A | | 10/1905 | Bernheisel | |
| 815,211 | A | | 3/1906 | Pattee et al. | |
| 953,489 | A | | 3/1910 | Cleghorn | |
| 2,196,093 | A | | 4/1940 | Bartlett | 104/53 |
| 2,221,414 | A | | 11/1940 | Schmidt | 104/53 |
| 2,895,735 | A | * | 7/1959 | Bartlett | 472/59 |
| 3,192,880 | A | | 7/1965 | Bergstrand | 105/454 |
| 3,457,876 | A | | 7/1969 | Holden | 104/89 |
| 3,680,487 | A | | 8/1972 | Cirami | 104/53 |
| 3,780,665 | A | | 12/1973 | Lohr et al. | 104/69 |
| 3,791,305 | A | | 2/1974 | Matelan | 104/69 |
| 3,855,936 | A | | 12/1974 | Schwarzkopf | 104/63 |
| 4,086,726 | A | * | 5/1978 | Moses | 49/37 |
| 4,170,943 | A | | 10/1979 | Achrekar | 104/56 |
| 4,520,732 | A | | 6/1985 | Schwarzkopf | 104/53 |
| D285,330 | S | | 8/1986 | Okamoto | D21/242 |
| 4,693,186 | A | | 9/1987 | Lisa | 105/329.1 |
| 4,874,162 | A | * | 10/1989 | Trumbull et al. | 272/18 |
| D317,642 | S | | 6/1991 | Hashimoto | D21/247 |
| 5,136,227 | A | | 8/1992 | Nakano et al. | 318/689 |
| 5,161,628 | A | * | 11/1992 | Wirth | 177/137 |
| 5,193,462 | A | | 3/1993 | Marcu | 104/138.1 |
| 5,218,910 | A | | 6/1993 | Mesmer et al. | 104/63 |
| 5,272,984 | A | | 12/1993 | Bolliger et al. | 104/63 |
| 5,463,962 | A | | 11/1995 | Gnezdilov | 104/55 |
| 5,473,990 | A | * | 12/1995 | Anderson et al. | 104/85 |
| 5,511,812 | A | * | 4/1996 | Milner | 280/433 |
| 5,623,878 | A | * | 4/1997 | Baxter et al. | 104/85 |

(List continued on next page.)

FOREIGN PATENT DOCUMENTS

| | | | | |
|---|---|---|---|---|
| DE | 17 28 555 | | 8/1976 | |
| EP | 0136833 A2 | * | 4/1985 | A63G/31/16 |
| JP | 3111374 A | * | 3/1995 | B60C/23/02 |
| WO | WO91/13662 | | 9/1991 | |
| WO | WO-91/13662 A1 | * | 9/1991 | A63G/7/00 |

*Primary Examiner*—S. Joseph Morano
*Assistant Examiner*—Frantz F. Jules
(74) *Attorney, Agent, or Firm*—David P. Gordon; David S. Jacobson; Thomas A. Gallagher

(57) ABSTRACT

A roller coaster ride includes a pair of spaced apart parallel tracks and a car assembly. The car assembly includes a superstructure with wheels which engage the track and a passenger compartment which is coupled to the superstructure but force-isolated from it by force controlling devices. According to the presently preferred embodiment, the force controlling devices include springs and pneumatic cylinders. The pneumatic cylinders are preferably controlled by an electrically operated pump/valve in response to signals from the roller coaster operator and/or a computer. The passenger compartment is preferably provided with a plurality of sensors for sensing velocity and acceleration as well as the condition of doors and restraints. According to one embodiment of the invention, the outputs from sensors are transmitted to the roller coaster operator and the operator manually activates pumps/valves to alter the forces acting on the passenger compartment. According to a second embodiment, the outputs from sensors are transmitted to a central computer which sends signals to the pumps/valves in response to a program which responds to the sensor signals. According to a third embodiment, the outputs from sensors are transmitted to an onboard computer which sends signals to the pumps/valves in response to a program which responds to the sensor signals.

23 Claims, 4 Drawing Sheets

U.S. PATENT DOCUMENTS 5,711,670 A * 1/1998 Barr ..... 434/55
5,725,435 A * 3/1998 De Castro Faria ..... 472/47
5,732,962 A 3/1998 Mageren et al. ..... 280/111
5,748,473 A * 5/1998 Breed et al. ..... 364/424.055
5,758,583 A * 6/1998 Lohr ..... 105/72.2
5,791,254 A 8/1998 Mares et al. ..... 104/53
5,934,176 A 8/1999 Mentink et al. ..... 97/37
5,947,030 A 9/1999 Spieldiener et al. ..... 104/250
5,979,827 A 11/1999 Corcoran ..... 244/122 R
6,007,338 A 12/1999 DiNunzio et al. ..... 434/55
6,059,274 A * 5/2000 Owen et al. ..... 267/136
6,095,926 A * 8/2000 Hettema et al. ..... 472/59
6,124,647 A * 9/2000 Marcus et al. ..... 307/10.1
6,220,171 B1 * 4/2001 Hettema et al. ..... 104/53

* cited by examiner

ROLLER COASTER CAR HAVING A FORCE-ISOLATED PASSENGER COMPARTMENT

BACKGROUND OF THE INVENTION

1. Field of the Invention

The present invention relates to amusement ride systems, and in particular, roller coasters. More specifically, the invention relates to a roller coaster car having a passenger compartment which is isolated by force controlling devices such as springs and pneumatic cylinders.

2. State of the Art

Roller coasters have enjoyed immense popularity in the United States and elsewhere for over one hundred years. These rides often consist of a passenger carrying vehicle, or collection of vehicles joined together, which traverse along a track system. Historically, the track system typically comprised a pair of parallel rails which exhibit steep upward and downward gradients in elevation, and sharp left and right banking turns. Aside from supplying the passenger with a pleasing panoramic view from high elevations, the main objective of the roller coaster ride was to thrill the passenger by traversing the track at the fastest possible speed while maintaining an acceptable degree of safety. The thrill experienced by the passenger thus arose through the sensations of rapid acceleration, brought about through rapid changes in vertical and horizontal direction of movement.

Innovations in roller coaster design have sought to enhance and intensify passenger thrill by substantially increasing the speed of movement along the track system, and hence, the resulting forces of acceleration experienced by the passenger. These innovations were greatly facilitated by technological advances in materials engineering, a direct result of which enabled the construction of stronger and lighter track systems and passenger vehicles. However, attendant with ever increasing speeds of the passenger vehicles is the ever increasing risk of catastrophic failure of the ride. As a result, other innovations sought to enhance and intensify passenger thrill by incorporating increasingly complex geometries into the track system itself. Two of the more common track geometries which have thus evolved are the loop and the helix.

In parallel with the aforedescribed track system geometries, there also exist innovations in passenger vehicle configurations for enhancing and intensifying passenger thrill. These innovations typically depart from the conventional roller coaster in that the passenger vehicle no longer assumes the standard railway car configuration. For example, Achrekar (U.S. Pat. No. 4,170,943) discloses a suspended passenger vehicle configuration whereby individual passenger units are rotated and translated in a multiplanar manner as the carriage assembly proceeds along a Mobius strip, or one-half section of helical track. A more recent departure from the conventional passenger vehicle configuration is disclosed in Bolliger et al. (U.S. Pat. No. 5,272,984). The invention disclosed in Bolliger enables passengers to be suspended from a bogie moving along a horizontal track system, so that a seated passenger's head is in closer proximity to the bogie—and hence the track rails—than are the passenger's body and limbs. This configuration results in a passenger vehicle being designed so that each passenger is suspended with his legs in mid-air without a wall or a floor around him.

Although advancements in roller coaster technology allow the passenger vehicles to experience higher speeds and accelerations than ever before, there are biological limits to the speed and acceleration which can be sustained by a person of ordinary health. Moreover, except for the advances described above, the essential roller coaster experience has remained unchanged over the years.

SUMMARY OF THE INVENTION

It is therefore an object of the invention to provide an improved roller coaster ride.

It is also an object of the invention to provide methods and apparatus for a new type of roller coaster experience.

It is another object of the invention to provide methods and apparatus for providing a visual roller coaster experience which is different from the force and acceleration experience.

In accord with these objects which will be discussed in detail below, the roller coaster of the present invention includes a pair of spaced apart parallel tracks and a car assembly which is adapted to ride on the tracks. The car assembly includes a superstructure with wheels which engage the track and a passenger compartment which is coupled to the superstructure but force-isolated from it by a plurality of force controlling devices. According to the presently preferred embodiment, the force controlling devices include springs and pneumatic cylinders. The pneumatic cylinders are preferably controlled by an electrically operated pump/valve in response to signals from the roller coaster operator and/or a computer. The passenger compartment is preferably provided with a plurality of sensors for sensing velocity and acceleration as well as the condition of doors and restraints. According to a first embodiment of the invention, the outputs from sensors are transmitted to a central computer which sends signals to the pumps/valves in response to a program which responds to the sensor signals to alter the forces acting on the passenger compartment. According to a second embodiment, the outputs from sensors are transmitted to an onboard computer which sends signals to the pumps/valves in response to a program which responds to the sensor signals. According to a third, less preferred embodiment of the invention, the outputs from sensors are transmitted to the roller coaster operator and the operator manually activates pumps/valves.

The invention provides a new kind of roller coaster experience by altering the forces sensed by passengers so that the force sensation differs from what would be expected from the visual sensation. It also permits the car assembly to experience forces which are higher than the forces experienced by the passenger compartment.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
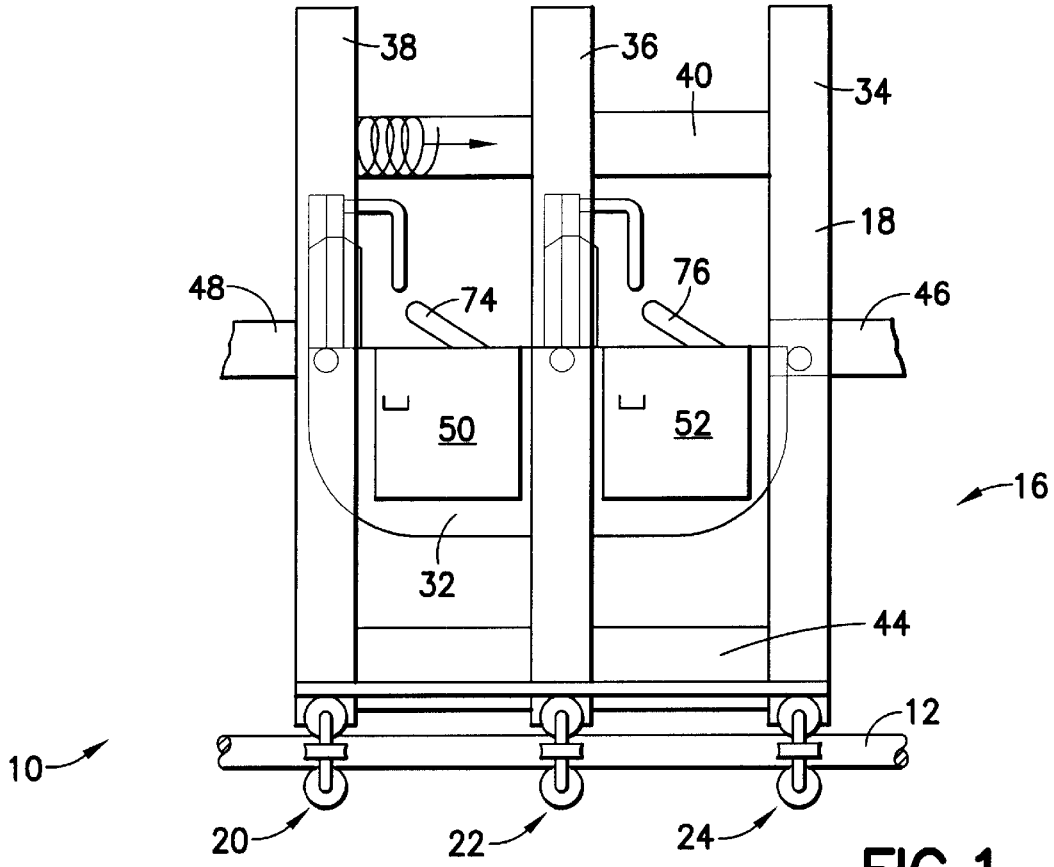
FIG. 1 is a schematic transparent side elevational view of a car assembly coupled to a track.
Figure 2:
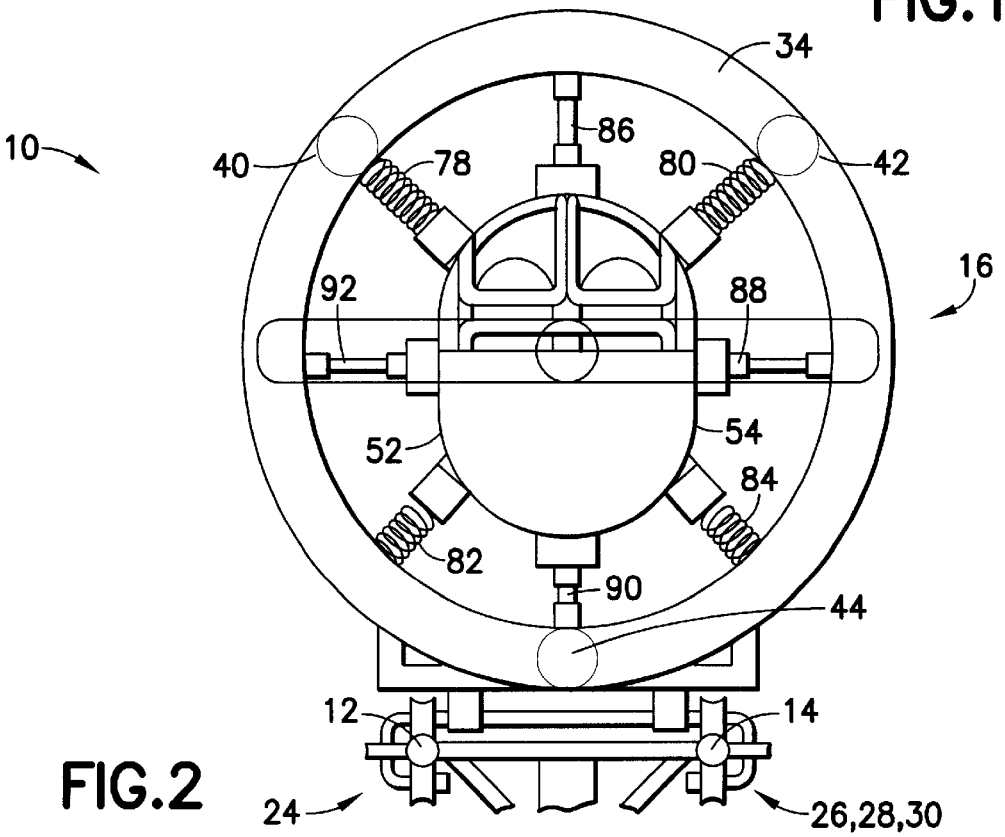
FIG. 2 is a schematic front end view of the car assembly coupled to the track.

Referring now to FIGS. 1 and 2, the roller coaster 10 of the present invention includes a pair of spaced apart parallel tracks 12, 14 and a car assembly 16 which is adapted to ride on the tracks 12, 14. The car assembly 16 includes a superstructure 18 with wheel assemblies 20, 22, 24, 26, 28, 30 (28 and 30 not seen behind 26 in FIG. 2) which engage the track and a passenger compartment 32 which is coupled to the superstructure but force-isolated from it by a plurality of force controlling devices described in more detail below with reference to FIG. 2.

As illustrated, the super structure 18 includes three spaced apart rings 34, 36, 38 which are coupled to each other by six spaced apart struts 39, 40, 41, 42, 43, 44. The first ring 34 and the last ring 38 are preferably provided with an additional linking member 46, 48 for coupling the car 16 to two other substantially identical cars. Each of the three rings is provided with a pair of wheel assemblies and each wheel assembly consists of three wheels, a top wheel, a bottom wheel, and a side wheel.

Figure 3:
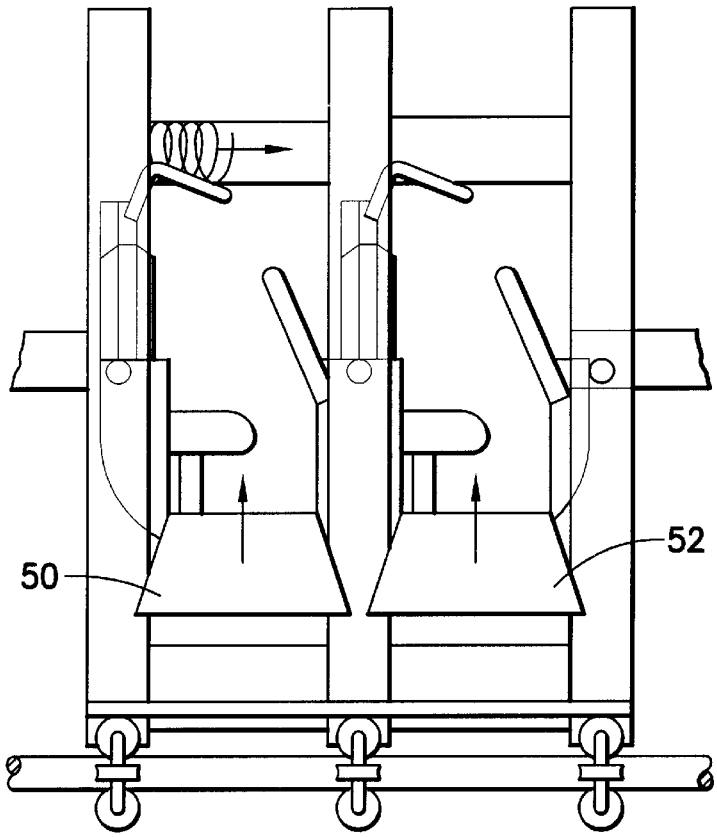
FIG. 3 is a view similar to FIG. 1 showing the doors to the passenger compartment in an open position.
Figure 4:
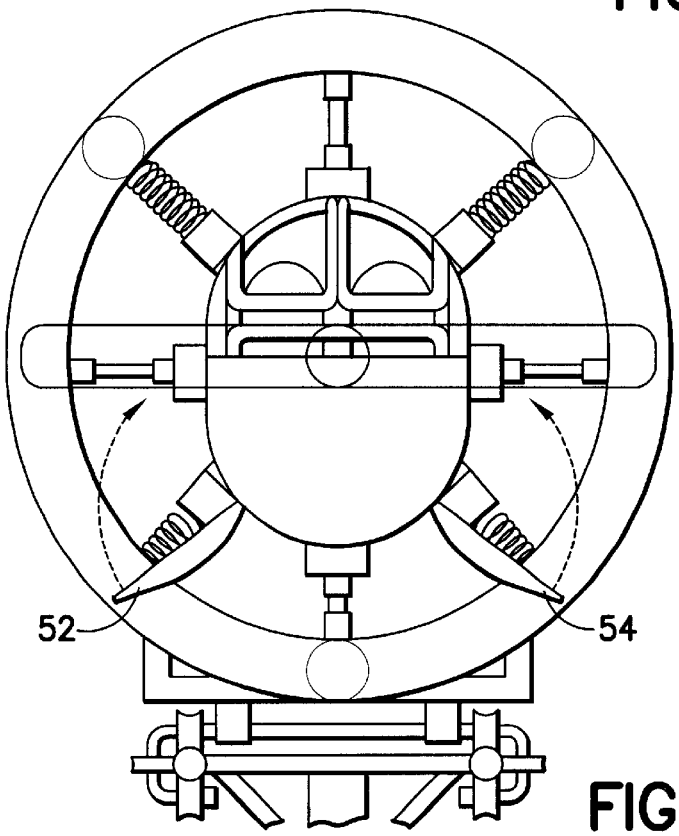
FIG. 4 is a view similar to FIG. 2 showing the doors to the passenger compartment in an open position.

As illustrated, the passenger compartment 32 includes four doors 50, 52, 54, 56 (56 being hidden in the drawing), four seats, 58, 60, 62, 64, four shoulder restraints 66, 68, 70, 72, and two arm restraints 74, 76. As shown in FIGS. 3 and 4, the doors open down and out and provide treads for walking up into the passenger compartment. The shoulder and arm restraints open up and out to allow access to the seats. The doors and the restraints are controlled by pneumatic cylinders (not shown) which are electrically operable as explained below with reference to FIG. 6.

Referring now in more detail to FIG. 2, the isolating devices, as illustrated, include four shock absorbing springs 78, 80, 82, 84 and four pneumatic cylinders 86, 88, 90, 92. The springs are spaced evenly, about 90° apart from each other. The pneumatic cylinders are also spaced evenly, about 90° apart from each other. As illustrated, the pneumatic cylinders are oriented substantially in the vertical and horizontal planes and the springs are oriented substantially in planes which are about 45° to the vertical and horizontal planes.

Figure 5:
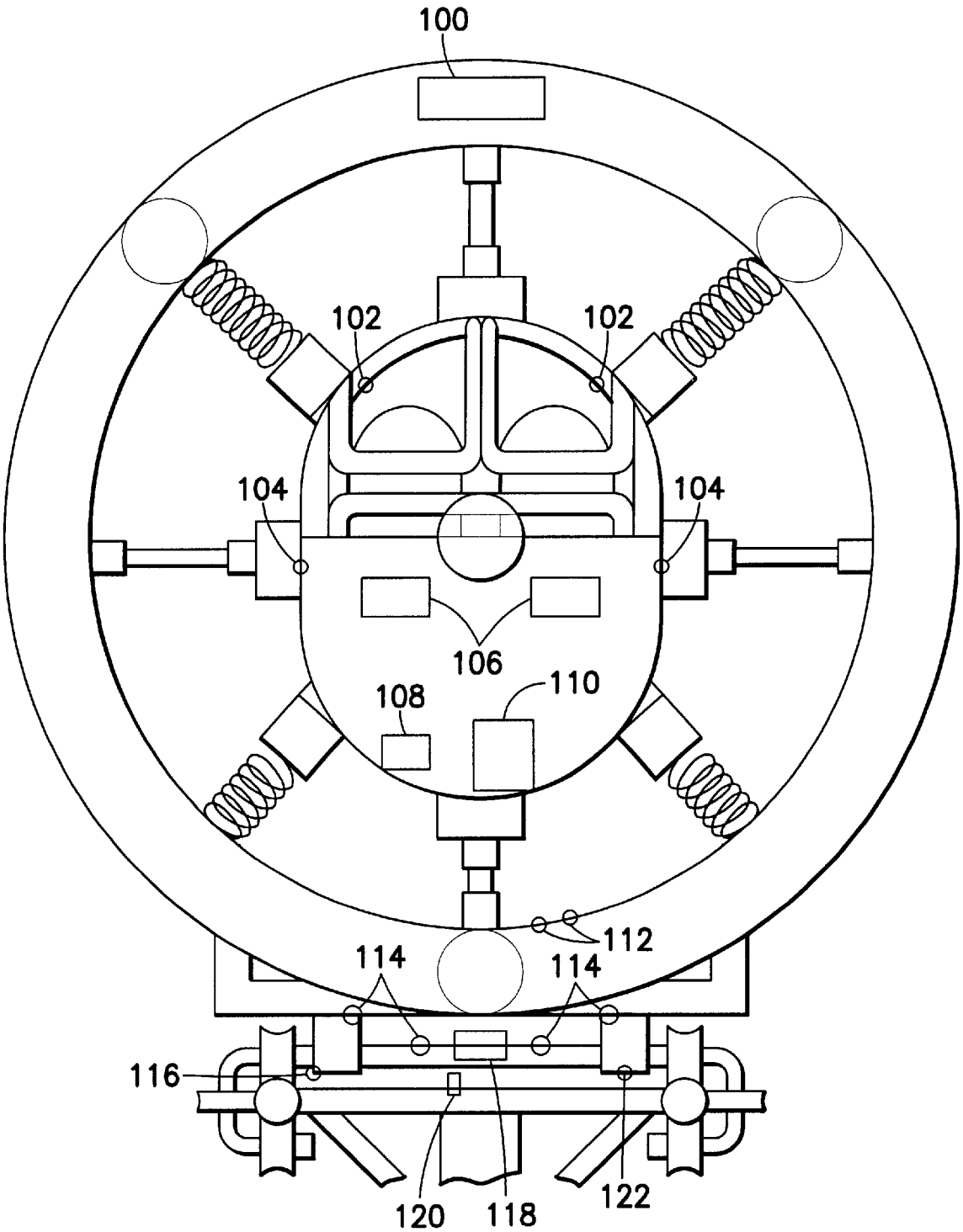
FIG. 5 is a view similar to FIG. 1 showing control elements according to one embodiment of the invention.

As mentioned above, the pneumatic cylinders are preferably controlled by one or more electrically operated pumps/valves in response to signals from the roller coaster operator and/or a computer. According to one embodiment, the cylinders are controlled by a central controller which is exterior of the roller coaster car, e.g. at an operator's station. The central control can be either humanly operable or, more preferably, computer controlled. FIG. 5 illustrates one way of implementing this embodiment. As shown in FIG. 5, the control elements of the roller coaster car include at transceiver 100, restraint sensors 102, door lock sensors 104, air pumps/compressors 106, accelerometers 108, a backup battery 110, door lock and restraint override switches 112, air pumps/compressors 114, a velocity sensor 116, a power transformer 118, an optional electrical conduct or 120, and a track/drive condition sensor 122.

All of the sensors are coupled to the transceiver which transmits their signals to a central location (not shown). The air pumps/compressors are activated based on the signals received from the sensors. The two pumps/compressors 106 operate the passenger compartment doors and the restraints. The four pumps/compressors 114 operate the four pneumatic cylinders. According to this embodiment, the car is also provided with brakes (not shown) which are operable from signals received by the transceiver. Operation of this embodiment essentially consists of actuating the appropriate pneumatic cylinders in response to signals from the accelerometers, actuating the brakes in response to signals from the velocity sensor or the track/drive condition sensor, and opening the doors and restraints after the car has been stopped at the loading/unloading station. The over ride switches can be used to unlock the doors and the restraints in an emergency. The track/drive condition sensor signals information about the condition of the track and the driving mechanisms which propel the car on the track. The conductor 120 contacts an optional "third rail" (not shown) from which power can be obtained.

The embodiment shown in FIG. 5 can be operated to cancel certain forces imparted on the passenger compartment. In this instance, the pneumatic cylinders are discharged and the passenger vehicle is free to move against the springs in response to acceleration forces which can be resolved into one of the four spring vectors. After the spring is fully compressed (acceleration peaked), the appropriate cylinders are charged to damp the movement of the passenger compartment under action of the compressed spring. This embodiment can also be operated to enhance the forces acting on the passenger compartment. In this instance, knowledge of the track layout is preferred. Just prior to the car approaching a point in the track where it will experience acceleration forces which can be resolved into one of the four spring vectors, the appropriate cylinders are charged to move the car against the appropriate spring and compress it. At the point when the car is experiencing the acceleration force imparted by the track layout, the cylinder is discharged allowing the spring to exert additional force on the passenger compartment thereby amplifying the force exerted on the passenger compartment.

From FIGS. 2, 4, and 5, those skilled in the art will appreciate that activation of cylinders 86 and 88 will move the passenger compartment against spring 82. Activation of cylinders 88 and 90 will move the passenger compartment against spring 78. Activation of cylinders 90 and 92 will move the passenger compartment against spring 80. Activation of cylinders 92 and 86 will move the passenger compartment against spring 84.

Figure 6:
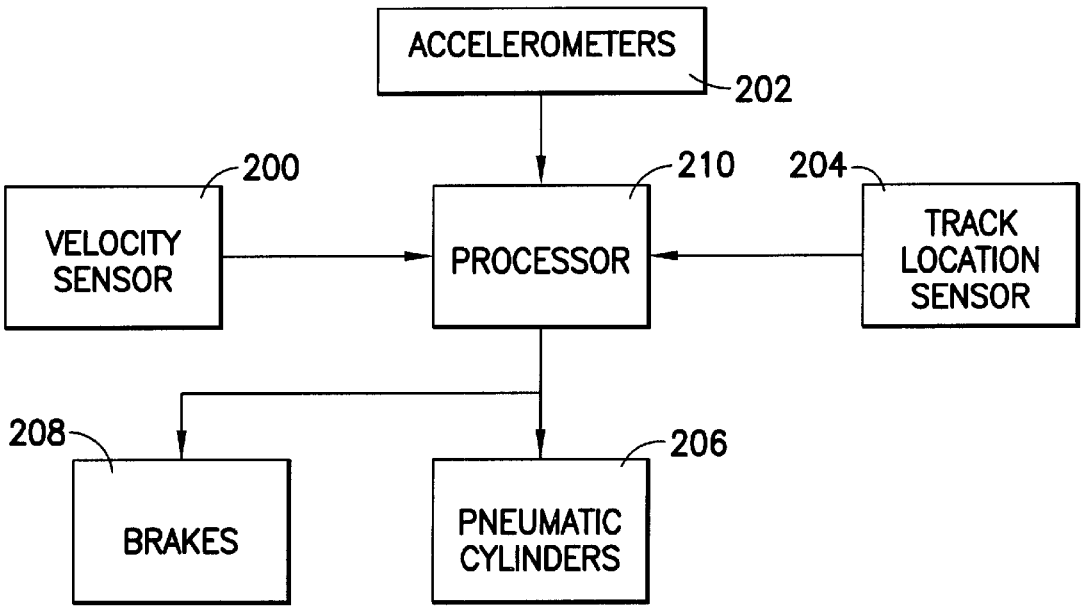
FIG. 6 is a schematic block diagram showing control elements of another embodiment of the invention.

As mentioned above, according to one embodiment, the outputs from sensors are transmitted to an onboard computer which sends signals to the pumps/valves in response to a program which responds to the sensor signals. FIG. 6 is a simplified schematic diagram of this embodiment and FIG. 7 is a simplified flow chart of the program which responds to sensor signals.

Referring now to FIG. 6, a velocity sensor 200, accelerometers 202, track location sensor 204, brakes 208, and pneumatic cylinders 206 are all coupled to a processing unit 210 which is programmed as described below with reference to FIG. 7. The pneumatic cylinders 206 may be the same in number and location as those described above with reference to FIGS. 2, 4, and 5. The number and location of the accelerometers 202 preferably corresponds to the number and location of cylinders 206. The track location sensor 204 is preferably a short range receiver which receives location information from short range transmitters located at various locations along the track. The range of the transmitters and receiver is such that the receiver receives location information only at the moment the receiver passes by a transmitter. As mentioned previously, this embodiment can be operated with or without the springs described above with reference to FIGS. 2, 4, and 5. FIG. 7 illustrates the general operation of this embodiment, with or without springs.

Figure 7:
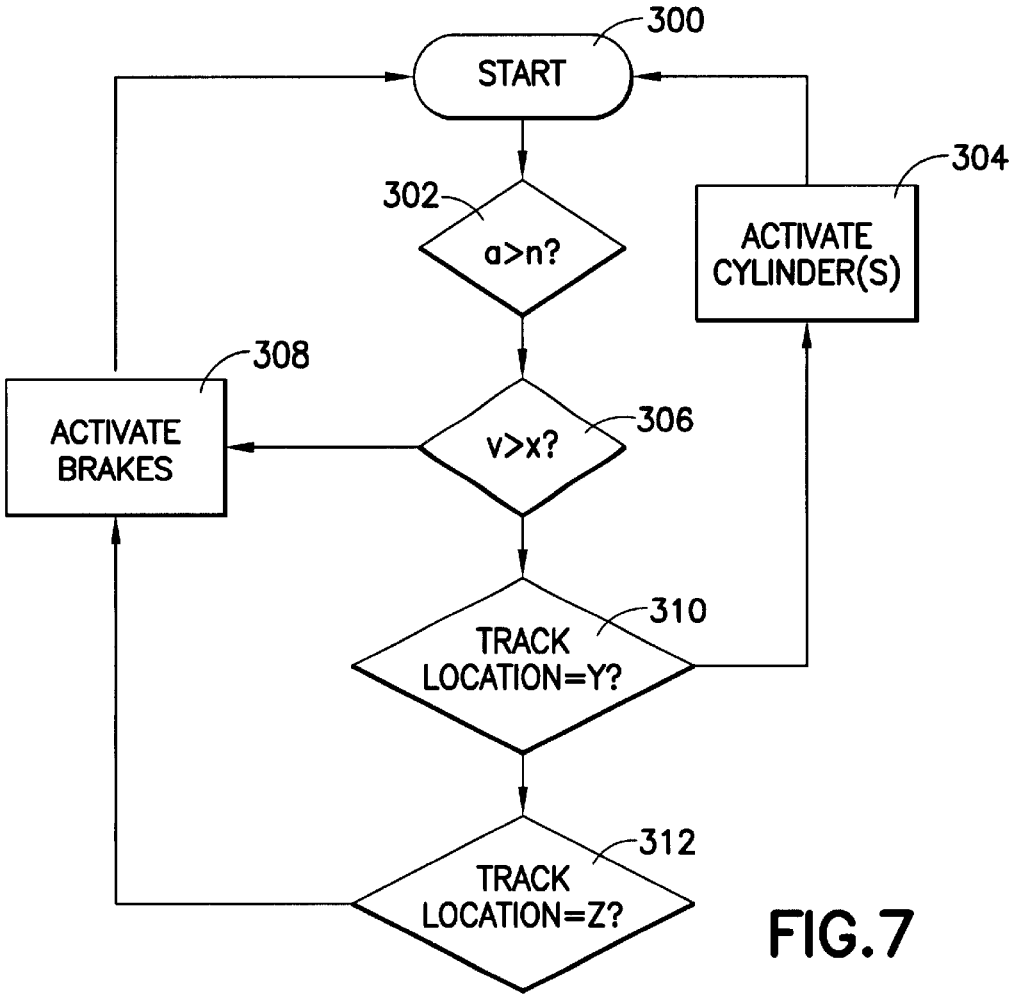
FIG. 7 is a simplified flow chart illustrating the basic operation of the embodiment of FIG. 6.

Turning now to FIG. 7, from a start 300, input from the accelerometers is checked at 302 and appropriate cylinders actuated at 304 in response thereto. As described above, cylinders can be actuated in a manner to reduce forces of acceleration or to enhance them. Where springs are used, force is minimized by actuating cylinders after acceleration has peaked. Velocity is checked at 306 and brakes are applied at 308 if the velocity is above a preset threshold. This can be programmed as a regular feature of the ride or for an emergency use only. Track location is checked at 310 and 312. Track locations can be programmed to cause cylinders to be charged/discharged at 304 or brakes activated/deactivated at 308. As mentioned above, forces may enhanced by actuating cylinders before acceleration and releasing them at the start of acceleration based on knowledge of track location. Moreover, the track can be designed so that the car reaches an uncomfortably rapid velocity as it approaches a track location and is automatically slowed "at the last minute" via the track location sensor. Furthermore, regardless of whether springs are used, cylinders can be charged or discharged according to track location in order to avoid apparent collisions between the passenger compartment and a suspended object. Those skilled in the art will appreciate that the superstructure of the car will need to be provided with a discontinuity through which an object suspension rod or the like may pass.

There have been described and illustrated herein several embodiments of a roller coaster car having a force-isolated passenger compartment. While particular embodiments of the invention have been described, it is not intended that the invention be limited thereto, as it is intended that the invention be as broad in scope as the art will allow and that the specification be read likewise. For example, while springs and pneumatic cylinders have been shown, other force controlling devices such as hydraulic cylinders, torsion bars, etc. could be used. Also, while the superstructure has been shown to ride atop the track, it could be adapted to be suspended from a track. In addition, while the superstructure has been described as having rings coupled to each other by struts, other designs could accomplish the same purpose. Moreover, while the passenger compartment has been shown as accommodating four passengers, larger or smaller passenger compartments could be provided. It will therefore be appreciated by those skilled in the art that yet other modifications could be made to the provided invention without deviating from its spirit and scope as so claimed.

What is claimed is:

1. A roller coaster car, comprising:

a) a superstructure having wheels adapted to ride on a track;

b) a passenger compartment coupled to said super structure;

c) a plurality of force controlling devices coupled to said superstructure and said passenger compartment for altering forces imparted on said passenger compartment; and d) a force sensor for measuring force exerted on said passenger compartment and producing an electrical signal in response thereto.

2. A roller coaster car according to claim 1, wherein:

said plurality of force controlling devices includes at least one pneumatic cylinder.

3. A roller coaster car according to claim 2, wherein:

said plurality of force controlling devices includes at least one spring.

4. A roller coaster car according to claim 1, wherein:

at least one of said force controlling devices is electrically operable.

5. A roller coaster car according to claim 1, further comprising:

e) transceiver means coupled to said force sensor and said at least one electrically operable force controlling device, wherein said electrical signal is transmitted to a location outside said roller coaster car, and said at least one electrically operable force controlling device is operable from said location outside said roller coaster car.

6. A roller coaster car according to claim 5, wherein:

said force sensor-includes at least one accelerometer.

7. A roller coaster car according to claim 1, further comprising:

e) processor means coupled to said force sensor and said at least one electrically operable force controlling device, wherein said processor means receives said electrical signal and operates said at least one electrically operable force controlling device in response to said electrical signal and a program.

8. A roller coaster car according to claim 7, wherein:

said force sensor includes at least one accelerometer, and said program is designed to activate said at least one electrically operable force controlling device in such a way as to mitigate acceleration of said passenger compartment.

9. A roller coaster ride, comprising:

i) a track; and ii) at least one roller coaster car, said car comprising a) a superstructure having wheels adapted to ride on said track;

b) a passenger compartment coupled to said super structure;

c) a plurality of force controlling devices coupled to said superstructure and said passenger compartment for altering forces imparted on said passenger compartment; and d) a force sensor for measuring force exerted on said passenger compartment and producing an electrical signal in response thereto.

10. A roller coaster ride according to claim 9, wherein:

said plurality of force controlling devices includes at least one pneumatic cylinder.

11. A roller coaster ride according to claim 10, wherein:

said plurality of force controlling devices includes at least one spring.

12. A roller coaster ride according to claim 9, wherein:

at least one of said force controlling devices is electrically operable.

13. A roller coaster ride according to claim 9, wherein said roller coaster car further comprises:

e) transceiver means coupled to said force sensor and said at least one electrically operable force controlling device, wherein said electrical signal is transmitted to a location outside said roller coaster car, and said at least one electrically operable force controlling device is operable from said location outside said roller coaster car.

14. A roller coaster ride according to claim 13, wherein:

said force sensor includes at least one accelerometer.

15. A roller coaster ride according to claim 9, wherein said roller coaster car further comprises:

e) processor means coupled to said force sensor and said at least one electrically operable force controlling device, wherein said processor means receives said electrical signal and operates said at least one electrically operable force controlling device in response to said electrical signal and a program.

16. A roller coaster ride according to claim 15, wherein:

said force sensor includes at least one accelerometer, and said program is designed to activate said at least one electrically operable force controlling device in such a way as to mitigate acceleration of said passenger compartment.

17. A roller coaster ride according to claim 9, wherein:

said at least one car includes a plurality of substantially identical cars.

18. A roller coaster ride according to claim 17, wherein:

said plurality of cars are coupled in a string.

19. A roller coaster ride according to claim 9, further comprising:

iii) locating means for determining the location of said car relative to locations on said track; and iv) actuation means coupled to said locating means and said force controlling devices for actuating one or more of said force controlling devices at predetermined track locations.

20. A roller coaster ride, comprising:

i) a track;

ii) at least one roller coaster car, said car comprising a) a superstructure having wheels adapted to ride on said track;

b) a passenger compartment coupled to said super structure; and c) a plurality of translation devices coupled to said superstructure and said passenger compartment for moving said passenger compartment relative to said superstructure;

iii) locating means for determining the location of said car relative to locations on said track; and iv) actuation means coupled to said locating means and said translation devices for actuating one or more of said translation devices at predetermined track locations.

21. A roller coaster car, comprising:

a) a superstructure including a first ring and a second ring, said first ring having a first diameter lying in a first plane, said second ring having a second diameter lying in a second plane which is spaced apart from and substantially parallel to said first plane;

b) a passenger compartment extending completely through said first plane; and c) a plurality of dynamic force controlling devices coupled to said first ring and to said passenger compartment for altering forces exerted on said passenger compartment, said passenger compartment being movable relative to said first and second planes.

22. A roller coaster car according to claim 21, wherein:

said plurality of force controlling devices includes at least four force controlling devices spaced approximately ninety degrees apart.

23. A roller coaster car according to claim 21, wherein:

said passenger compartment includes at least one door which opens down and out and provides treads for walking up into said passenger compartment.

* * * * *